United States Patent [19]

Civitello

[11] 4,078,468

[45] Mar. 14, 1978

[54] APPARATUS FOR EXTENDING A LOWER RANGE OF A STRINGED MUSICAL INSTRUMENT

[76] Inventor: Simon Civitello, 513 Edward Ct., Orange, Conn. 06477

[21] Appl. No.: 734,440

[22] Filed: Oct. 21, 1976

[51] Int. Cl.[2] ..... G10D 3/06

[52] U.S. Cl. ..... 84/274; 84/297 R; 84/314

[58] Field of Search ..... 84/173, 267–269, 84/274, 293, 297 R, 312, 314, 318

[56] References Cited

U.S. PATENT DOCUMENTS

| | | | |
|---|---|---|---|
| 1,870,623 | 8/1932 | Goss et al. | 84/297 R |
| 2,504,752 | 4/1950 | Sullivan | 84/312 X |
| 3,636,809 | 1/1972 | Ezaki | 84/267 X |

*Primary Examiner*—Lawrence R. Franklin

*Attorney, Agent, or Firm*—DeLio and Montgomery

[57] ABSTRACT

A stringed musical instrument such as a member of the viol family, in particular a bass viol, having a string with a length longer than the classical length and hence an extended lower range. An extended neck and fingerboard are provided and a clamp at the end of the standard fingerboard releasably clamps the extended string at its classical length when the extended range is no longer needed.

16 Claims, 8 Drawing Figures

APPARATUS FOR EXTENDING A LOWER RANGE OF A STRINGED MUSICAL INSTRUMENT

BACKGROUND OF THE INVENTION

1. Field of the Invention

The invention relates generally to the field of stringed musical instruments of the bass viol family, and more specifically to apparatus for extending downwardly the musical range of at least one string to preselected lower pitch.

2. Description of the Prior Art

In general, a player of a stringed musical instrument such as the bass viol is limited in the range and the combination of tones and pitches that can be produced with the standard instrument. In this, the pitches of the strings are limited by their tension, mass and vibrating length, the lengths being varied downwardly (the pitches of the strings being varied upwardly) by the player. Sometimes it is desirable to extend the low range, that is, that of the unfingered open string, of a particular string while playing, when it is impractial to de-tune the instrument, otherwise reduce the tension in the string or add still another string. This is true in particular of the lowest bass string of which there is not pitch overlap in a lower string.

Apparatus is known in the art capable of varying the pitch of a stringed instrument upwardly by increasing the tension of the string. This does not, however, solve the problem of intermittently extending the low range of an instrument. Furthermore, with the use of such tension varying apparatus, it is very difficult to establish the desired (changed) pitch precisely. The tension-varying apparatus known in the prior art do not lock onto the string at the desired tension but must be constantly held by the player, thereby necessitating the constant use of a finger, hand or foot with the inherent possibilities of fatigue or vibration causing an instability in the tone achieved. Tension varying apparatus also work only to increase the tension and hence increases the pitch of the particular tuned string.

SUMMARY OF THE INVENTION

It is therefore an object of the invention to provide a stringed musical instrument capable of having an extended low range as well as the classical range.

It is another object of the invention to provide a stringed musical instrument in which the low range of at least one of the strings may be varied by a preselected amount by varying the open unfingered length of the string.

It is yet another object of the invention to provide a stringed musical instrument having a novel clamp and neck arrangement for precisely locating the normal operating length of the extended string and thus the normal open pitch of the string, wherein said string has an extended low operating range and an extended length.

Still other objects and advantages of the invention will in part be obvious and will in part be apparent from the specification.

The invention accordingly comprises an article of manufacture possessing the features, properties, and the relation of elements which will be exemplified in the article hereinafter described, and the scope of the invention will be indicated in the claims.

In brief, the invention provides a stringed musical instrument, in particular by way of illustration a bass viol, having a lower-pitched bass string, with a longer open vibratile length than the classical length of the bass string of an ordinary classical bass viol. An extended neck and fingerboard permits the extended string to be fingered in the normal manner. A clamp is provided to clamp the string at the classical length if the extended length is not immediately needed. The extended string with the clamp being opened adds four musical half steps extending the range of the instrument from a low "C" to the low "E".

BRIEF DESCRIPTION OF THE DRAWINGS

The aforementioned objects and features of the invention, as well as other objects and features, will be better understood upon consideration of the following detailed description, when read in conjunction with the drawings, in which.

DETAILED DESCRIPTION OF THE PREFERRED EMBODIMENT

Figure 1:
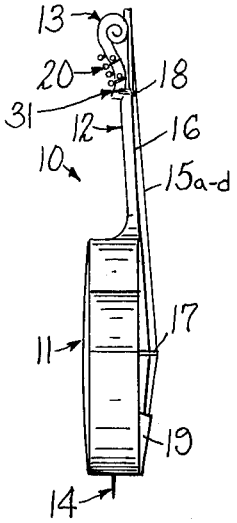
FIG. 1 is a side view of a bass viol embodying the invention.
Figure 2:
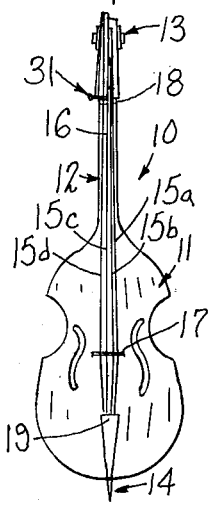
FIG. 2 is a front elevational view of the bass viol shown in FIG. 1.

With reference to FIGS. 1 and 2, the invention provides a bass viol generally designated at 10 and having a body 11, a neck 12 and a scroll 13 at the end of neck 12. A stand 14 is provided by which the bass viol may be held off the floor while being held upright in the playing position. The viol is further provided with the standard four strings **15*a* - 15*d*, string 15*d* extending to the lowest pitch, and 15*a* to the highest pitch. A fingerboard 16 is provided on the neck 12 proximate the strings 15*a* - 15*d* which permits the strings to be fingered, that is, the string is pinched between the player's finger and the fingerboard at different positions, thereby changing the vibratile portion of the string and thereby changing its pitch. A bridge 17 near the center of body 11 and a nut 18 are provided to hold the strings at a preselected distance from the fingerboard. The strings are held at their lower end by a string anchor 19, and pass over bridge 17, nut 18, and are held at their upper end by tuning means 20 disposed in scroll 13**.

Figure 3:
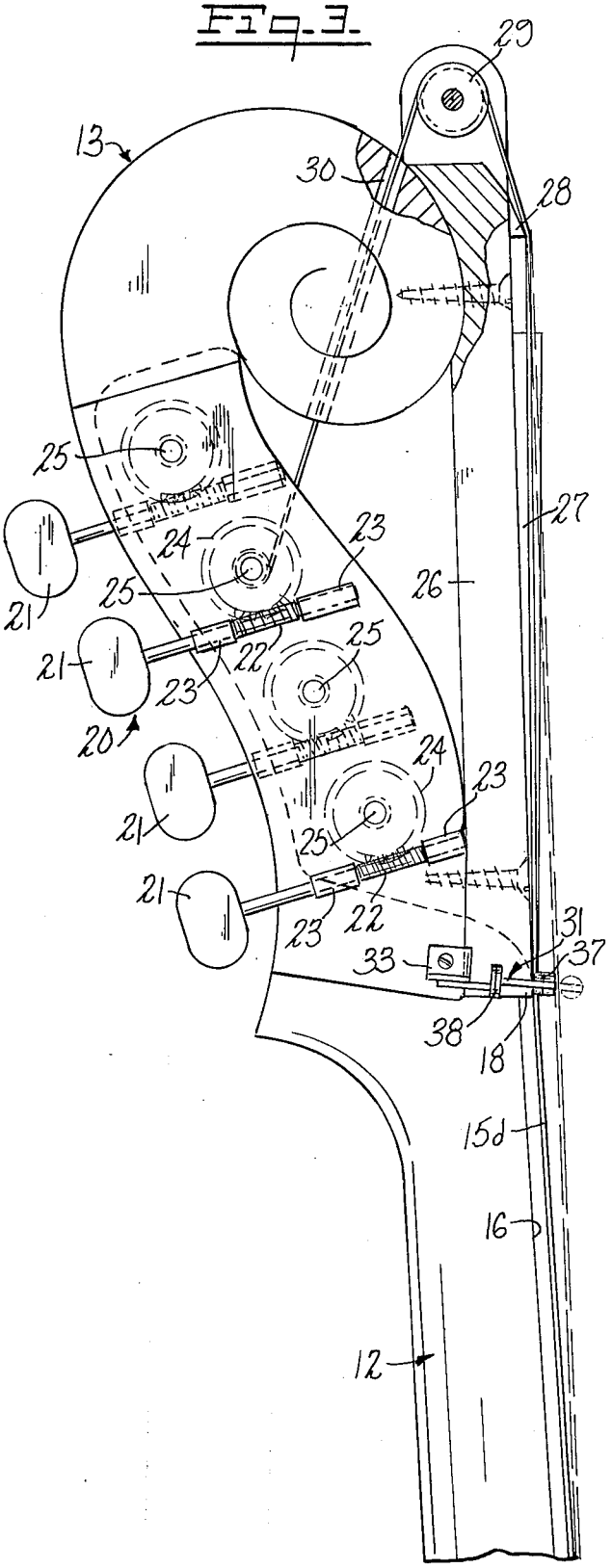
FIG. 3 is a fragmentary view partially in section of the scroll of the bass viol shown in FIG. 1 showing the extended neck and fingerboard and clamp.
Figure 4:
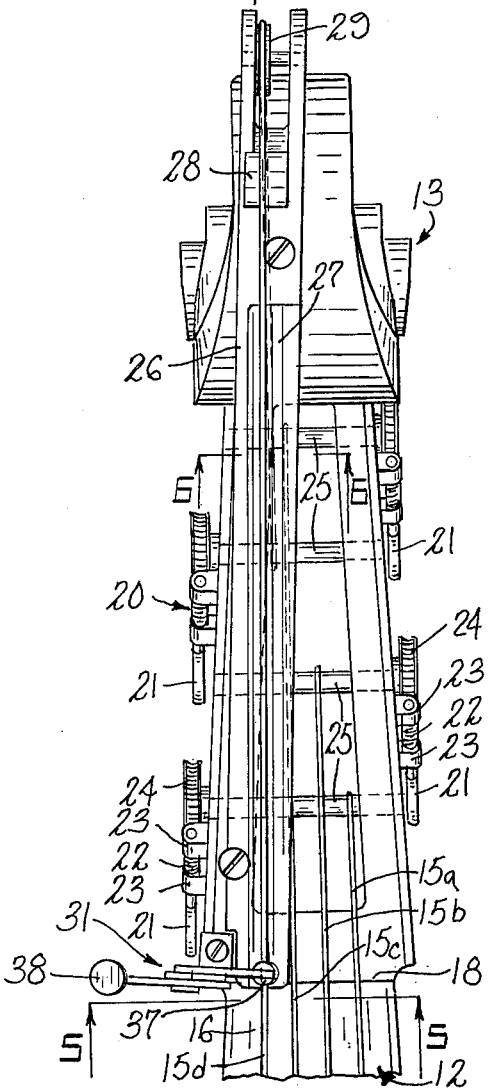
FIG. 4 is a front elevational view of the scroll shown in FIG. 3.

With reference to FIGS. 3 and 4, tuning means 20 comprises a plurality of rotatable winding knobs 21 connected to worm gears 22. The worm gears 22 are rotatably held against longitudinal movement by anchor means 23. Worm gears 22 are meshed with respective rotatable detented wheels 24 which are in turn axially connected to a rotatable shaft 25 to which respective strings **15*a* - 15*d* are individually attached. By turning winding knobs 21 the shafts 25 are rotated, which causes the strings to be wound tighter onto shafts 25 or to be loosened, depending on the direction in which the knobs 21** are turned. This serves to increase or decrease tension in the strings.

In accordance with the invention, an extended neck 26 is provided attached to the front of scroll 13. Extended neck 26 further has an extended fingerboard 27 and an upper nut 28 which cooperates with bridge 17 to maintain string 15*d* spaced apart from extended fingerboard 27 as well as fingerboard 16. Roller 29 is provided at the upper edge of extended neck 26 to allow string 15*d* to pass over and around the end thereof and pass back to its particular associated tuning apparatus. A hold 30 is provided through the top of scroll 13 to allow string 15*d* to extend straight from roller 29 to tuning apparatus 20.

With further reference to FIGS. 3 and 4, a clamp 31 is provided at the lower end of extended neck 26, at nut 18, to clamp string 15*d* against nut 18 when the extended string is not needed. With the string clamped, string 15*d* is at its original classical length, giving it the classical rather than the extended range.

Figure 5:
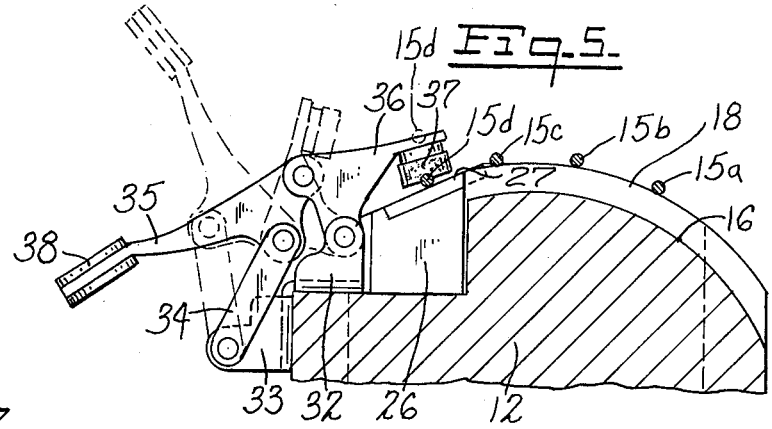
FIG. 5 is a sectional view taken along line 5—5 of FIG. 4.

With reference to FIG. 5 clamp 31 provides a pair of anchors 32 and 33 attached to the front and side of neck 12, respectively. A connecting rod 34 is pivotally connected to anchor 33 and to actuator 35. Anchor 32 is itself pivotally attached to member 36 which is also rotatably connected to actuator 35 at a pivot point spaced apart from the connection with connecting rod 34. Member 36 is further connected to clamping pad 37 which serves to clamp string 15*d* to nut 18. In the clamped position with string 15*d* clamped to its classical length and range, as shown in the solid lines in FIG. 5, connecting rod 34 and actuating member 35 are dimensioned so as to force the pivotal connection therebetween in towards neck 12, which serves to lock the clamp closed. In opening clamp 31, the key end 38 of actuating member 35 is moved up and to the right as shown in the phantom lines in FIG. 5. Since connecting rod 34 maintains a constant radius, member 36 is drawn down and to the left thereby releasing string 15*d*.

Figure 6:
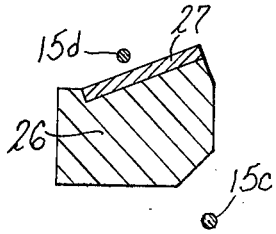
FIG. 6 is a sectional view taken along line 6—6 of FIG. 4.

With reference to FIG. 6, a cross-section of extended neck 26 is shown further showing the disposition of the strings with respect thereto. The string having the extended range, string 15*d*, is disposed above extended neck 26 and extended fingerboard 27 as seen in FIG. 6, and string 15*c*, which has a normal range, is disposed therebelow.

Figure 7:
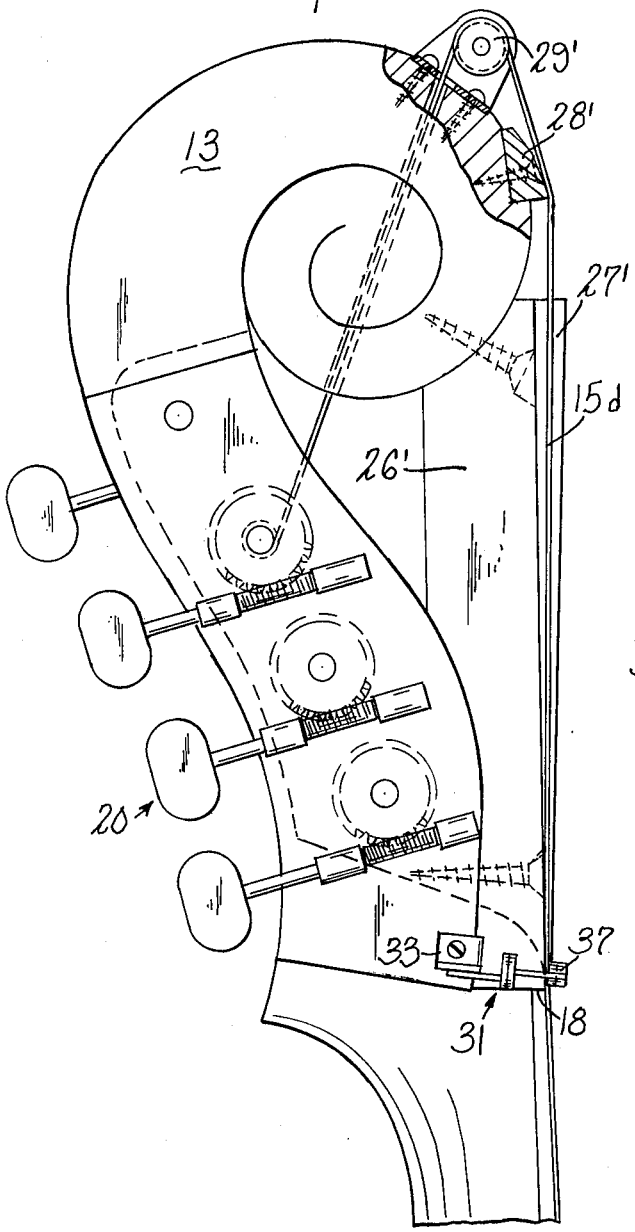
FIG. 7 shows a modification of the extended neck and fingerboard shown in FIG. 3.

FIG. 7 discloses a modification of the embodiment shown in FIG. 3 wherein roller 29' and nut 28' are attached directly to the end of scroll 13. In this configuration, extended neck 26' and extended fingerboard 27' do not extend as high on scroll 13 as in the embodiment shown in FIG. 3.

Figure 8:
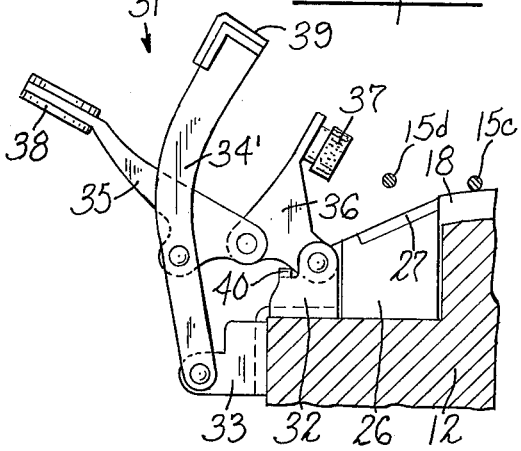
FIG. 8 shows a modification of the clamping device shown in FIG. 5.

With reference to FIG. 8, modified clamp 31' includes an extended connecting rod 34' which extends beyond the pivotal connection with actuating member 35 to provide a second actuable release 39. With modified clamp 31' either key end 38 or second release 39 may be used to open and close clamp 31'. With key end 38, the clamp operates as described above with respect to clamp 31. If extended end 39 is used, the end is pushed leftwardly as shown in FIG. 8, thereby utilizing actuating member 35 as a radius arm to pivot member 36 counterclockwise and release string 15*d*. A stop 40 is provided to prevent member 36 from pivoting beyond a preselected position. Clamp 31' is returned to its clamped position by pivoting second release 39 to the right and clockwise as shown in FIG. 8 which moves member 35 to the right and pivots member 36 clockwise around anchor 32. Stop 40 is provided to prevent member 36 from pivoting beyond the point at which it would continue to rotate counterclockwise when extended end 39 is pivoted to the right. Modified clamp 31' permits the rapid clamping or release of string 15*d* by the musician while he is fingering the base viol, as extended end 39 extends substantially closer to the fingerboard than does key end 38.

The invention may be used with suitable modification with any stringed musical instrument; the embodiment shown with a bass viol is by way of illustration only.

It will thus be seen that the objects set forth above, among those made apparent from the preceding description are efficiently attained and, since certain changes may be made in the above construction without departing from the spirit and scope of the invention, it is intended that all matter contained in the above description or shown in the accompanying drawings shall be interpreted as illustrative and not in a limiting sense.

What is claimed is:

1. A stringed musical instrument having a plurality of strings, at least one of said strings having a classical range and an extended low range, said musical instrument comprising:

body and neck means for holding said strings;

fingerboard means to allow said strings to be fingered, said fingerboard means having an end;

means associated with said end for establishing the low pitch of each of said strings;

extended fingerboard means extending beyond said end to allow said extended string to be fingered, said extended fingerboard means having an end distal to said fingerboard means;

means associated with said extended fingerboard means for establishing the low pitch of said extended string; and means for releasably clamping said extended string at said end to restore said extended string to its classical length and classical range when said extended string is clamped.

2. A musical instrument as defined in claim 1 further comprising means associated with said body and cooperating with said low pitch establishing means for holding said strings spaced apart from said fingerboard means.

3. A musical instrument as defined in claim 1 further comprising roller means situated at the distal end of said extended neck.

4. A musical instrument as defined in claim 1 further comprising extended neck means underlying said extended fingerboard means, said extended fingerboard means being supported by said extended neck means.

5. A musical instrument as defined in claim 1 in which said clamping means releasably locks in the clamped position.

6. A musical instrument as defined in claim 1 in which the extended string has the lowest classical pitch.

7. A stringed musical instrument having a plurality of strings, at least one of said strings having an extended low range and a classical range, said musical instrument comprising:

a body;

an elongated neck extending from said body having an end distal thereto;

a scroll extending from said distal end of said neck, said scroll including means for tuning said strings by varying the tensions thereof;

fingerboard means disposed on said neck and means for holding said strings spaced apart from said fingerboard means;

extended neck means extending from said distal end of said neck and extended fingerboard means disposed on said extended neck means;

means for holding said extended string spaced apart from said extended fingerboard means and from said fingerboard, and means for releasably clamping said extended string at the distal end of said neck thereby restoring said extended string to its classical length and classical range when said string is clamped.

8. A musical instrument as defined in claim 7 further comprising a roller situated on the end of said extended neck distal to said neck, said extended string passing over said roller to said tuning means.

9. A musical instrument as defined in claim 7 further comprising a roller situated on said scroll, said string passing over said roller to said tuning means.

10. A musical instrument as defined in claim 7 wherein said musical instrument is a bass viol.

11. For use with a stringed musical instrument having fingerboard means, apparatus for varying the low range of at least one of the strings by a preselected amount by varying the vibratile length of said string, said extended string having an extended length, comprising:

means adapted to support the extended portion of said extended string;

fingerboard extension means associated with said supporting means adapted to allow said extended string to be fingered; and means adapted to releasably clamp said string at said fingerboard to restore said extended string to its classical length and classical range when said string is clamped.

12. Apparatus as defined in claim 11 wherein said supporting means comprises neck extension means.

13. Apparatus as defined in claim 11 wherein said neck extension has situated thereon roller means and means for maintaining said extended string spaced apart from said fingerboard extension means.

14. Apparatus as defined in claim 11 wherein said supporting means comprises roller means and means for maintaining said extended string spaced apart from said fingerboard extension means both adapted to be situated on said musical instrument.

15. Apparatus as defined in claim 11 wherein said clamping means comprises:

first anchor means and second anchor means, a first radius means pivotally connected to said first anchor means, a second radius means pivotally attached to said second anchor means, said second radius means including a clamping pad, and connecting means pivotally attached to said first radius means and said second radius means, said connecting means further having actuator means extending therefrom.

16. Apparatus as defined in claim 15 wherein said first radius means further includes second actuator means extending therefrom.

* * * * *